US012655747B1

(12) United States Patent
Yilmaz et al.

(10) Patent No.: US 12,655,747 B1
(45) Date of Patent: Jun. 16, 2026

(54) MEMORY CASING COLLAR LOCATOR-GAMMA RAY TOOL CARRIER FOR COILED TUBING APPLICATIONS

(71) Applicant: SAUDI ARABIAN OIL COMPANY, Dhahran (SA)

(72) Inventors: Koray Yilmaz, Udhailiyah (SA); Abdulaziz Omar Aqeel, Al Ahsa (SA); Mustafa Radhi Alzaid, Al Ahsa (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 19/224,290

(22) Filed: May 30, 2025

(51) Int. Cl.
*E21B 47/017* (2012.01)
*E21B 47/09* (2012.01)

(52) U.S. Cl.
CPC ..... *E21B 47/017* (2020.05); *E21B 47/09* (2013.01)

(58) Field of Classification Search
CPC ..... E21B 47/09; E21B 47/017
See application file for complete search history.

(56) References Cited

U.S. PATENT DOCUMENTS

| | | | |
|---|---|---|---|
| 441,561 | A | 11/1890 | Holloway |
| 7,073,582 | B2 | 7/2006 | Connell et al. |
| 8,917,094 | B2 | 12/2014 | Bittar et al. |
| 9,140,818 | B2 | 9/2015 | Zierolf et al. |
| 9,631,478 | B2 | 4/2017 | Livescu |
| 10,662,750 | B2 * | 5/2020 | Angman ..... E21B 43/1185 |
| 2014/0216734 | A1 | 8/2014 | Hupp |
| 2017/0138181 | A1 | 5/2017 | Ross et al. |
| 2019/0203538 | A1 | 7/2019 | Wisinger, Jr. et al. |

OTHER PUBLICATIONS

Burdin, K.V., "World's First Production Logging with Fiber Optic Enabled Coiled Tubing (Ct)," Spe No. 4-5 (037), pp. 32-43, Sep. 2011 (12 pages).
Dorsett, A et al., "Accurately Locating Casing Collars in Real Time with Drill Pipe Deployed Gamma Ray Density Measurement," SPE-188972-MS, pp. 1-10, Nov. 13, 2017 (10 pages).
Daniels, J et al., "High Density CCL Memory Tool To Confirm SSD Sleeve Position," SPE 68362, pp. 1-9, Mar. 7, 2001 (9 pages).

* cited by examiner

*Primary Examiner* — Tara Schimpf
*Assistant Examiner* — Lamia Quaim
(74) *Attorney, Agent, or Firm* — Osha Bergman Watanabe & Burton LLP

(57) ABSTRACT

Apparatus and method for a carrier sub for a coiled tubing in a well including an outer housing coupled to the coiled tubing, an inner housing disposed inside the outer housing defining an annulus between the inner and outer housing, and a sensor tool including a casing collar locator and a gamma ray tool inserted into the inner housing. The sensor tool is removable from the inner housing and is integrated with a memory system within the casing collar locator and the gamma ray tool for data storage of data measured by the casing collar locator and the gamma ray tool. The carrier sub further includes at least two flow ports in the inner housing to direct fluid flow out of the inner housing, into the annulus, and toward an exit of the carrier sub. The sensor tool is isolated from fluid communication with the well.

18 Claims, 3 Drawing Sheets

MEMORY CASING COLLAR LOCATOR-GAMMA RAY TOOL CARRIER FOR COILED TUBING APPLICATIONS

BACKGROUND

In the petroleum industry, accurate depth control and effective fluid circulation are critical for efficient production and maintenance in wellbores. Maintaining depth accuracy within feet-to-foot interval is essential for wells. Conventionally, gas and oil well are drilled to an upper depth of about 25,000 feet. In conventional wells, multiple tools operate sequentially. Precise depth correction is required for each tool. Position, orientation, and/or speed of a downhole tool may be variables of high significance. For example, when a downhole tool obtains measurements, it is important to know the depth at which the measurements were taken. However, finding orientation, speed, and position of a downhole tool is challenging. Typically, electric line (e-line) tools use depth measurements provided by the tools, which are transmitted through the e-line. Coiled tubing services often rely on surface-based depth counters to estimate a position of the tool.

In a well, casing is steel pipe cemented in place to stabilize the wellbore. The pipe usually includes multiple sections (referred to as casing joints) coupled together with casing collars to achieve the required length and specification for the wellbore. Conventionally, a casing collar locator is an electric logging tool used to detect the magnetic anomaly caused by the relatively high mass of the casing collar. Therefore, the conventional casing collar locator is used to obtain depth measurements of joint locations between two neighboring pipes and downhole tools. In wells, it is common that natural gamma counts are used to determine depth. Various rock layers produce gamma rays at varying intensities depending on lithology. A gamma log may be mapped on reference depth measurement to be used as depth reference for upcoming operations, such as logging.

Gamma ray (GR) logging and casing collar locator (CCL) memory tools are specifically engineered to operate effectively in extreme downhole conditions characterized by high temperatures and pressures. By running a GR logging tool in conjunction with the casing collar locator and correlating a cased-hole GR log to historical open-hole GR logs, depth of the cased-hole logs are tied to the open-hole GR logs, allowing for precise placement of downhole tools in relation to specific reservoir units or zones. GR logging and CCL memory tools are designed to detect gamma rays and record locations of casing collars.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a carrier sub for a coiled tubing in a well including an outer housing coupled to the coiled tubing, an inner housing disposed inside the outer housing defining an annulus between the inner housing and the outer housing, a sensor tool comprising a casing collar locator and a gamma ray tool inserted into the inner housing of the carrier sub, the sensor tool configured to be removable from the inner housing, wherein the sensor tool is integrated with a memory system within the casing collar locator and the gamma ray tool for data storage of data measured by the casing collar locator and the gamma ray tool, and at least two flow ports disposed in the inner housing configured to direct fluid flow out of the inner housing, into the annulus of the carrier sub, and toward an exit of the carrier sub, wherein the sensor tool is isolated from fluid communication with the well, via the at least two flow ports.

In one aspect, embodiments disclosed herein relate to a method for carrying a sensor tool in a coiled tubing in a well, including inserting the sensor tool comprising a casing collar locator and a gamma ray tool into an inner housing of a carrier sub, running the carrier sub with the coiled tubing into the well, wherein the inner housing is disposed inside an outer housing defining an annulus in the carrier sub, measuring data, via the casing collar locator and the gamma ray tool, storing measured data, via an integrated memory system within the casing collar locator and the gamma ray tool, directing fluid flow, via at least two ports disposed in the inner housing, out of the inner housing, into the annulus of the carrier sub, and toward an exit of the carrier sub, and isolating the sensor tool from fluid communication with the well by directing fluid flow via the at least two ports.

Other aspects and advantages of the claimed subject matter will be apparent from the following description and the appended claims.

DETAILED DESCRIPTION

Figure 1:
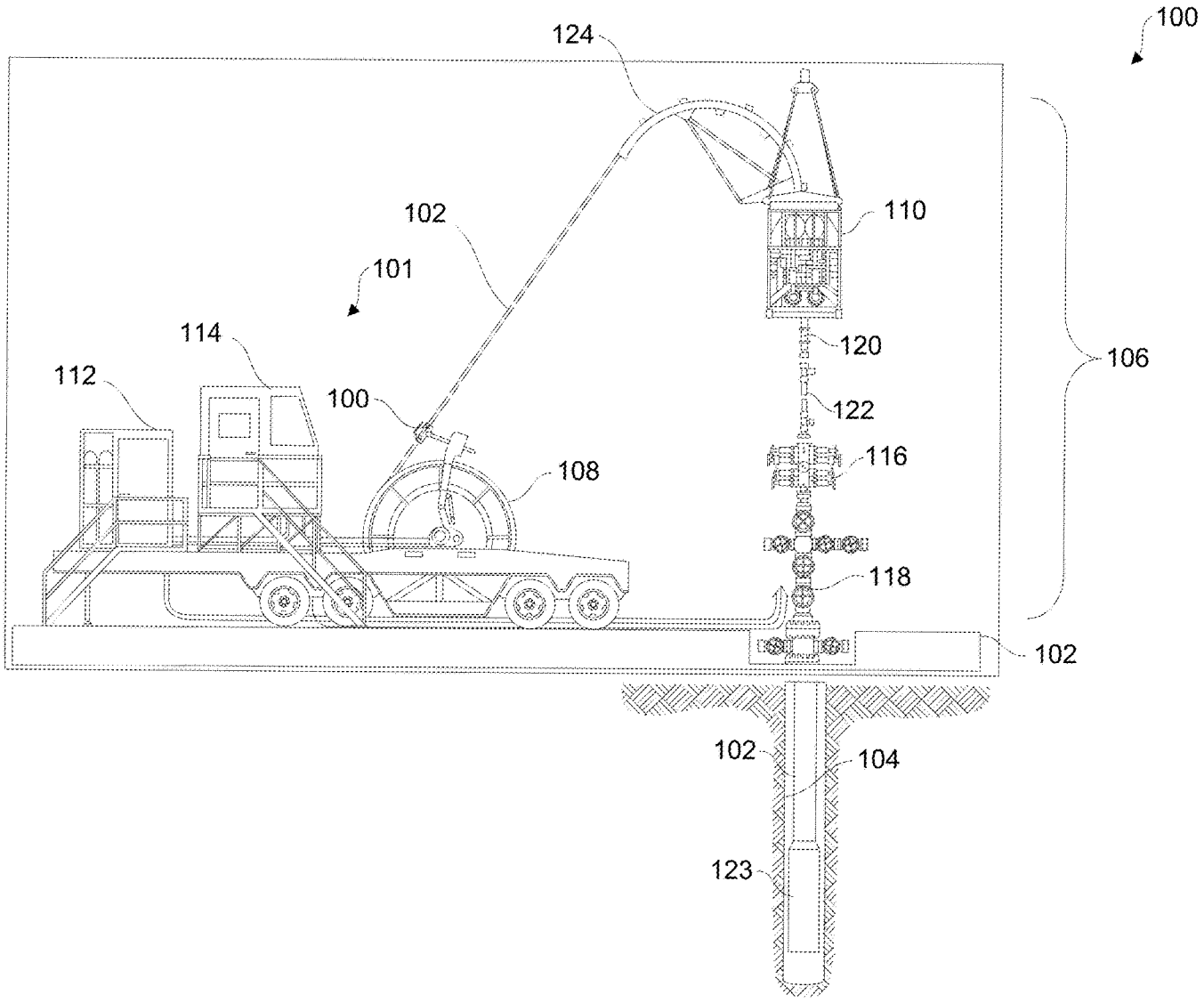
FIG. 1 shows a well system in accordance with one or more embodiments.

Specific embodiments of the disclosure will now be described in detail with reference to the accompanying figures. Like elements in the various figures are denoted by like reference numerals for consistency.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Embodiments disclosed herein are described with terms designating in reference to a tubular, but any terms designating should not be deemed to limit the scope of the disclosure. For example, a tubular string is made up of numerous tubular pipes joined end-to-end, and each of the tubular pipes might be about twenty to forty feet in length. Further, the tubular pipes are hollow and thus provide a continuous channel of communication between the surface and the bottom of the wellbore, down through which a suitable fluid can be introduced to any region required within the well. It is to be further understood that the various embodiments described herein may be used with various types of tubulars, including but not limited to casing or liners, without departing from the scope of the present disclosure. A casing generally refers to a large-diameter pipe that is lowered into an open hole and cemented in place.

Embodiments disclosed herein may refer to coiled tubing services used extensively for well intervention operations. Conventionally, coiled tubing services provide hydraulic circulation, a key component of coiled tubing operations, and convey a cleanout fluid through the wellbore to remove debris and fill. As part of this process, wellbore displacement is performed to disturb solid particles and remove debris and fill from the wellbore. Well displacement may be achieved by inserting a coiled tubing assembly into the wellbore and circulating the cleanout fluid through a downward-directed nozzle, while traversing through a substantial amount of fill. The wellbore is then free from debris and fill, such that the wellbore is ready for safe and efficient completion of subsequent operations. The nozzle may include a jetting action. Controlling pump rate of the cleanout fluid while running in hole or pulling out ensures that particulate solids remain up hole of the end of the tool assembly. Embodiments of this disclosure may reference terms including "run in hole" and "pull out of hole." The term "run in hole" refers to the process of inserting and lowering drilling equipment into the wellbore. The term "pull out of hole" refers to removing equipment from the well.

In general, embodiments of the disclosure describe GR logging and CCL memory tools specifically engineered to accurately detect gamma rays and measure locations of casing collars. In some embodiments, e-line services are used, such that real-time data is available from the surface.

In general, embodiments of the disclosure include systems and methods for carrying a sensor tool in a coiled tubing of a well in a carrier for locating casing collars and downhole tools. Knowing the location of a downhole tool may be important for various reasons. For example, a downhole tool may be configured to collect measurements of the properties of the wellbore. In order to enable interpretation of these measurements, it may be important to correlate the measurements with depth. Embodiments of this disclosure provide a carrier designed for running the sensor tool including memory CCL-GR tools with any other coiled tubing tool connections. The memory CCL-GR carrier includes an inner housing for facilitating enhanced fluid circulation to increase efficiency of coiled tubing well intervention operations.

With the memory CCL-GR carrier, fluid may be circulated continuously from an end of a bottom hole assembly (BHA) to improve coiled tubing well intervention operations. A person of ordinary skill in the art may appreciate that the BHA may include tools and equipment located at a bottom of a pipe string. The pipe string may include circulation and release subs, check valves, centralizers, nozzles or jetting tools, GR tools, and/or CCL tools. Although aspects of this invention are specifically described for coiled tubing operations, the carrier disclosed is not limited to wellbore displacement and correlation operations.

Conventional practice involves running a coiled tubing to perform wellbore displacement followed by a separate run in to perform memory CCL-GR for correlation purposes. Advantages of the embodiments disclosed herein include conducting wellbore displacement and memory CCL-GR operations simultaneously, expanding the capabilities of conventional bottom hole assemblies designed solely for wellbore cleaning purposes. Embodiments herein describe advantages including uninterrupted fluid flow around the GR logging and CCL memory tool to optimize wellbore circulation. Further advantages include secure placement of the memory tool within a tool string of the well. Compatibility with coiled tubing applications allows for seamless integration within the well intervention assembly.

FIG. 1 illustrates a system in accordance with one or more embodiments. As shown in FIG. 1, a well control system (100) may be located on a ground surface (e.g., a surface (102)) including a land unit (101) arranged to spool coiled tubing (102) into a wellbore (104) through surface equipment (106). Coiled tubing (CT) (102) may be continuous length of small-diameter pipe spooled onto a reel (108) on the land unit (101). The reel (108) may be a drum used for wrapping and storing coiled tubing (102). The reel (108) may include a drive system for maintaining proper tension between the reel (108) and an injector head (110). The land unit (101) may further include a power pack and accumulator unit (112) for powering the reel (108) and a control cabin (114) for controlling the reel (108). The power pack and accumulator unit (112) may supply power, such as hydraulic power, to the land unit (101) and surface equipment (106). The control cabin (114) may be sited to provide a clear view of a wellhead (118), the injector head (110), and the reel (108), such that an operator is able to view and control all the equipment, including the land unit (101) and the surface equipment (106). The surface equipment (106) may include a blowout preventor (BOP) (116), the injector head (110), and the Christmas tree or wellhead (118). Surface equipment (106) may further include other components, such as but not limited to side door strippers (120) and lubricator systems (122).

A person of ordinary skill in the art may appreciate that coiled tubing operations provide a "snubbing" technique. The "snubbing technique" includes placing and removing a continuous length of tubing, such as coiled tubing (102), in and out of a live well (i.e., wellbore (104)) through a stripper BOP (116) arrangement. The reel (108) may include a spooler head (110) for which the coiled tubing (102) passes through, so that the coiled tubing (102) is correctly coiled upon itself. During "snubbing" or running the coiled tubing (102) into the wellbore (104), the reel (108) is rotated to uncoil the coiled tubing (102). The reel (108) may be rotated using a hydraulic motor through a chain drive. The coiled tubing (102) may then passe through the spooler head (110) into a goose neck (124) or U-shaped pipe into the injector head (110). The injector head (110) may be any mechanism capable of transferring the necessary force to inject, retract, or hold the coiled tubing (102) with precision control while running or tripping into and out of the wellbore (104). The injector head (110) may grip the coiled tubing (102) using gripper blocks mounted on chains. The coiled tubing (102) may then proceed to be straightened and run through the surface equipment (106) and pushed into the wellbore (104). As such, circulation fluid may be pumped into the wellbore (104) through the coiled tubing (102), while the reel (108) is stationary or in motion.

Moreover, when performing well displacement, the circulation fluid is pumped through the coiled tubing (102) into the wellbore (104) to remove debris from the well. As further shown in FIG. 1, a carrier sub (123) may be coupled to coiled tubing, further described in FIG. 2 as carrier sub (200).

Figure 2:
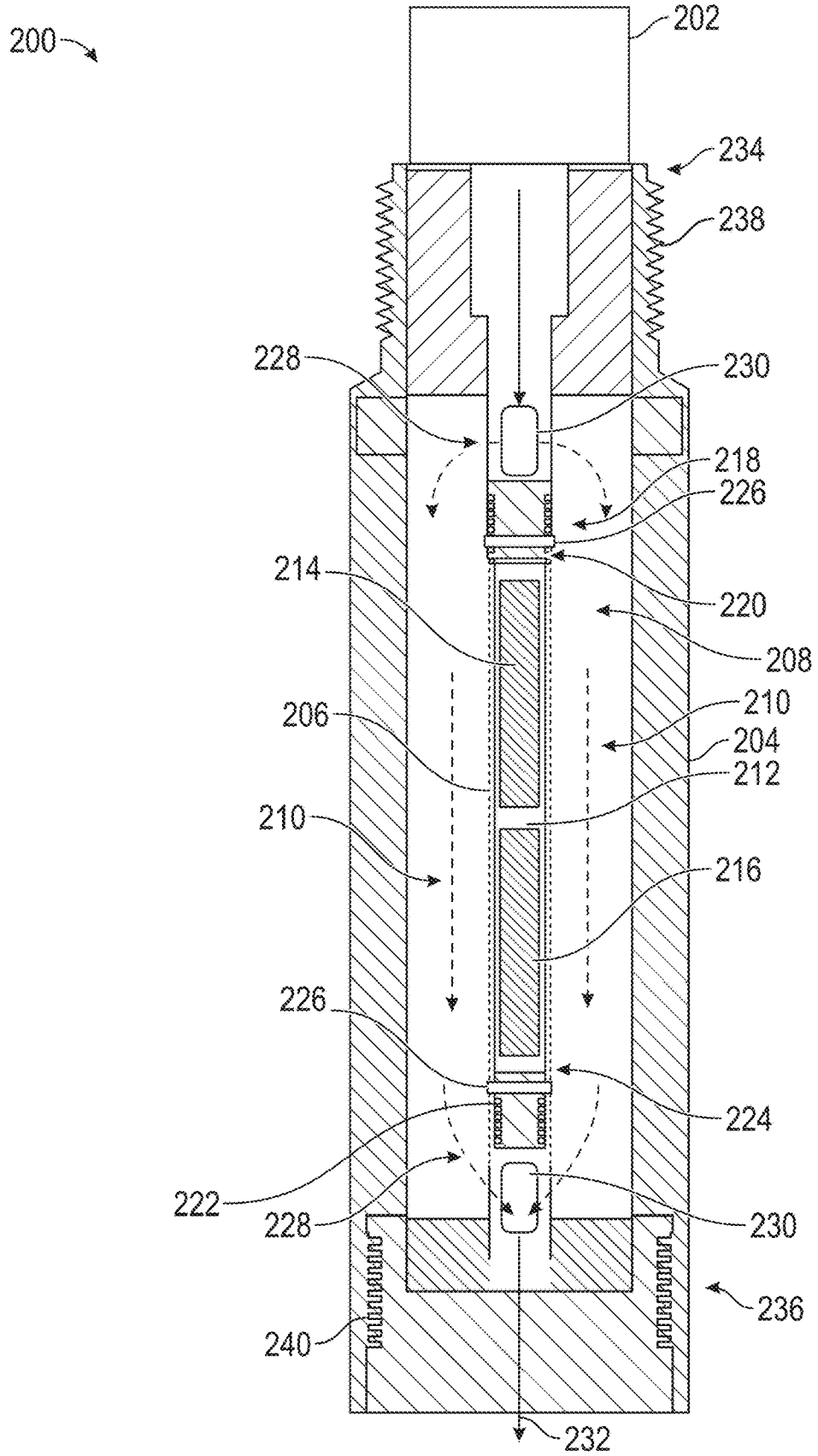
FIG. 2 shows a device in accordance with one or more embodiments.

FIG. 2 shows a device in accordance with one or more embodiments. Specifically, FIG. 2 shows a carrier sub (200) for a coiled tubing (202) (e.g., coiled tubing (102)) in a well (e.g., wellbore (104)). The carrier sub (200) may include a carrier assembly including a housing specifically designed to accommodate memory CCL-GR tools. For example, the carrier sub (200) includes an outer housing (204) coupled to the coiled tubing (202) and an inner housing (206) disposed inside the outer housing (204). A person of ordinary skill in the art would appreciate that the outer housing (204) is capable of being constructed to be assembled with other coiled tubing tools, such as a hanger, knuckle joints, control equipment, reel units, etc. The carrier sub (200) may be a ported sub. The inner housing (206) inside the outer housing (204) defines an annulus (208) between the inner housing (206) and outer housing (204). The annulus (208) may include a fluid flow path (210) for fluid, such as circulation fluid, to flow into the carrier sub (200).

A sensor tool (212) including a memory casing collar locator (214) and a memory gamma ray tool (216) is inserted into the inner housing (206) of the carrier sub (200). A person of ordinary skill in the art may appreciate that the memory casing collar locator (214) and the memory gamma ray tool (216) may include the CCL-GR tools discussed previously but integrated with a memory system for data storage of data measured by the CCL-GR tools. For example, data measured by the memory casing collar locator (214) and the memory gamma ray tool (216) may be stored in the sensor tool (212). Data may include surveys of the wellbore (104) measured by CCL-GR tools, such as depth data and gamma ray logs, as described previously. The integrated memory system within the CCL-GR tools store data during downhole operations without relying on real-time data transmission.

In some embodiments, the sensor tool (212) is designed to be removable from the inner housing (206). For example, FIG. 2 shows an upper threaded connection (218) located at an upper end of the sensor tool (220) and a lower threaded connection (222) located at a lower end of the sensor tool (224). Either of the upper threaded connection (218) or the lower threaded connection (222) may be considered a "first threaded connection" or a "second threaded connection." Either of the upper end or lower end may be considered a "first end" or a "second end." The upper threaded connection (218) is disposed at one end of the sensor tool (212). The lower threaded connection (222) is disposed at the other end of the sensor tool (212).

The carrier sub (200) design including the inner and outer housings (206, 204) facilitates convenient insertion and removal of the sensor tool, thereby enhancing operational flexibility. During installation, the sensor tool (212) is simply threaded into place. Once the sensor tool (212) is removed from the inner housing (206), the data or records from the memory casing collar locator (214) and memory gamma ray tool (216) may be evaluated. For example, the sensor tool (212) may be inserted and/or removed within the inner housing (206) by screwing or unscrewing the upper threaded connection (218) or the lower threaded connection (222). The lower threaded connection (222) may hold the sensor tool (212) in place inside the inner housing (206). The upper threaded connection (218) may be an inner threaded connection, while the lower threaded connection (222) may be an outer threaded connection. The upper and lower threaded connections (218, 222) may each include a seal (226) to prevent leakage and hold the components in place. The carrier sub (200) may be seamlessly integrated with coiled tubing bottom hole assemblies. Insertion and removal of the sensor tool (212) may be easily completed, ensuring quick access for maintenance or data retrieval. Additionally locking mechanisms are not necessary for removal of the sensor tool (212).

The carrier sub (200) includes at least two flow ports (228) or holes disposed in the inner housing (206) for directing fluid flow (210) in a path. As shown in FIG. 2, the fluid flow (210) is directed out of the inner housing (206), into the annulus (208) of the carrier sub (200), and toward an exit (232) of the carrier sub (200). The two flow ports (228) may include a flow nozzle (230) located in an upper end of the carrier sub (234) and a flow nozzle (230) located in a lower end of the carrier sub (236). A person of ordinary skill in the art may appreciate that the flow ports (228) may be any hydraulic connection capable of directing flow, such as flow nozzles or valves. The flow ports (228) isolate the sensor tool (212) from fluid communication with the well (104) by circulating the fluid around the sensor tool (212).

For example, the flow ports (228) direct fluid flow away from the sensor tool (212) by flowing fluid through a flow nozzle (230) uphole from the upper threaded connection (218), out from the inner housing (206), into the annulus (208), back into the inner housing (206) through a flow nozzle (230) downhole from the lower threaded connection (222), and toward the exit (232). The fluid flow path (210) described is continuous through the carrier sub (200) producing fluid circulation. The fluid circulation pathway may allow fluid to enter from one side pocket of the carrier sub (200) to the exit (232) from a bottom of the assembly and carrier sub (200). The fluid circulation of the carrier sub (200) ensures efficient fluid flow through the carrier sub (200) to enhance effectiveness of fluid circulation during coiled tubing operations. The flow nozzles (230) may maintain fluid circulation without obstructing the functionality of the sensor tool (212). The seals (226), described previously, may be any seals capable of ensuring fluid integrity while bypass ports maintain continuous flow around the seals (226).

In some embodiments, the first end of the carrier sub (200) includes a third threaded connection (238) for coupling a tool joint of the coiled tubing (202). The second end of the carrier sub (200) may include a fourth threaded connection (240) for holding the sensor tool (212) in place. The fourth threaded connection (240) may be coupled to another tool joint of the coiled tubing (202) ensuring mechanical continuity. The fourth threaded connection (240) may be slimmer or smaller in size than the third threaded connection (238). The third threaded connection (238) may include outer threads for holding the outer housing (204). The fourth threaded connection (240) may include inner threads for holding the inner and outer housings (206, 204). All of the threaded connections secure placement of the sensor tool (212) within the carrier sub (200) and coiled tubing.

Conventionally, coiled tubing operations involves using a bottom hole assembly to provide fluid circulation, then removing the circulation tools, and replacing the circulation tools with CCL-GR tools to survey the wellbore. The carrier sub (200) described herein allows for simultaneous execution of the two operations including surveying the wellbore with memory casing collar locator and gamma ray tool, while maintaining continuous and uninterrupted fluid circulation. Positioning the carrier sub (200) at the bottom of the pipe or tool string allows for efficient fluid circulation and effective wellbore cleaning and treatment.

Figure 3:
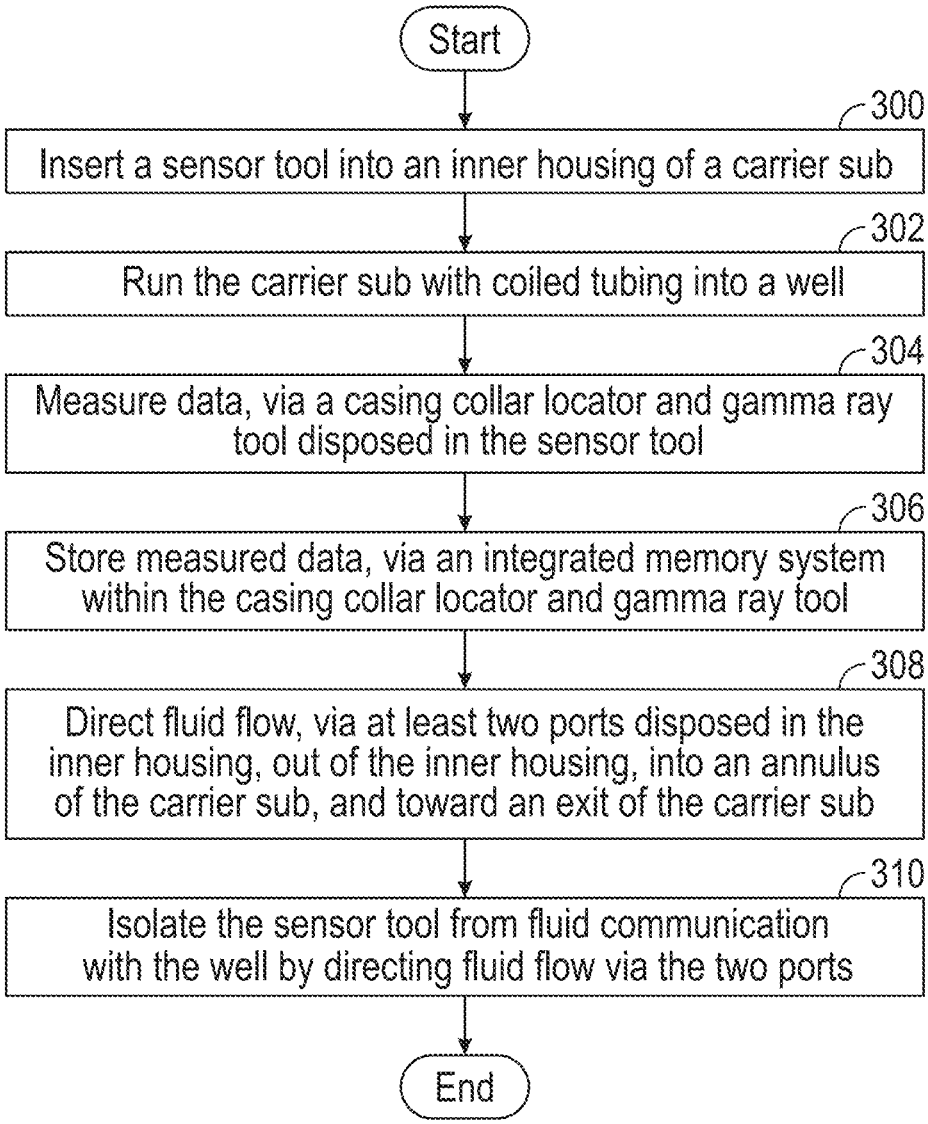
FIG. 3 shows a flowchart in accordance with one or more embodiments.

FIG. 3 shows a flowchart in accordance with one or more embodiments. Specifically, FIG. 3 describes a general method for carrying a sensor tool (e.g., sensor tool (212)) in a coiled tubing. One or more blocks in FIG. 3 may be performed by one or more components (e.g., carrier sub (200)) as described in FIGS. 1 and 2. While various blocks in FIG. 3 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In Block 300, a sensor tool is inserted into an inner housing of a carrier sub. The carrier sub includes an inner housing disposed inside an outer housing defining an annulus. The carrier sub may be a ported sub. The sensor tool includes a casing collar locator and a gamma ray tool. The sensor tool may be secured in place in the inner housing via an upper threaded connection disposed at an upper end of the sensor tool and a lower threaded connection of the sensor tool disposed at a lower end of the sensor tool. The sensor tool may be inserted by screwing the upper threaded connection or the lower threaded connection. The upper threaded connection may be inner threaded and the lower threaded connection may be outer threaded. The sensor may be sealed to the upper and lower threaded connections using a seal. In Block 302, a carrier sub is run into a well with coiled tubing.

In Block 304, data is measured, via the casing collar locator and gamma ray tool disposed in the sensor tool. In Block 306, an integrated memory system within the casing collar locator and the gamma ray tool stores the measured data. For example, the casing collar locator and the gamma ray tool are memory casing collar locator and memory gamma ray tool.

In Block 308, fluid flow is directed, via at least two ports disposed in the inner housing, out of the inner housing, into the annulus of the carrier sub, and toward an exit of the carrier sub. Fluid flow may be directed using flow nozzles. Fluid flow may be continuous through the carrier sub. In Block 310, the sensor tool is isolated from fluid communication with the well by directing fluid flow using the two ports.

The sensor tool may be removed from within the inner housing by unscrewing the upper threaded connection and/or the lower threaded connection. In some embodiments, a tool joint may be coupled to each end of the carrier sub via threaded connections. For example, a third threaded connection at an upper end of the carrier sub may be coupled to a tool joint. A fourth threaded connection at a lower end of the carrier sub may be coupled to another tool joint. The fourth threaded connection may be slimmer or smaller in size than the third threaded connection.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A carrier sub for a coiled tubing in a well comprising:

an outer housing coupled to the coiled tubing;

an inner housing disposed inside the outer housing defining an annulus between the inner housing and the outer housing;

a sensor tool comprising a casing collar locator and a gamma ray tool inserted into the inner housing of the carrier sub, the sensor tool configured to be removable from the inner housing, wherein the sensor tool is integrated with a memory system within the casing collar locator and the gamma ray tool for data storage of data measured by the casing collar locator and the gamma ray tool; and at least two flow ports disposed in the inner housing configured to direct fluid flow out of the inner housing, into the annulus of the carrier sub, and toward an exit of the carrier sub, wherein the sensor tool is isolated from fluid communication with the well, via the at least two flow ports.

2. The carrier sub of claim 1, further comprising:

a first threaded connection disposed at a first end of the sensor tool and a second threaded connection of the sensor tool disposed at a second end of the sensor tool configured to hold the sensor tool in place in the inner housing, wherein the sensor tool is configured to be inserted and removed within the inner housing by screwing and unscrewing the first threaded connection or the second threaded connection.

3. The carrier sub of claim 2, wherein the first threaded connection is an inner threaded connection and the second threaded connection is an outer threaded connection.

4. The carrier sub of claim 2, wherein the first threaded connection and the second threaded connection comprise a seal.

5. The carrier sub of claim 1, wherein the at least two flow ports each comprise a flow nozzle.

6. The carrier sub of claim 1, further comprising:

a first end of the carrier sub comprising a third threaded connection to couple to a first tool joint of the coiled tubing.

7. The carrier sub of claim 6, further comprising:

a second end of the carrier sub comprising a fourth threaded connection to hold the sensor tool in place and be coupled to a second tool joint of the coiled tubing.

8. The carrier sub of claim 7, wherein the fourth threaded connection is slimmer than the third threaded connection.

9. The carrier sub of claim 1, wherein fluid flow is continuous through the carrier sub.

10. A method for carrying a sensor tool in a coiled tubing in a well, the method comprising:

inserting the sensor tool comprising a casing collar locator and a gamma ray tool into an inner housing of a carrier sub;

running the carrier sub with the coiled tubing into the well, wherein the carrier sub comprises an outer housing and the inner housing disposed inside the outer housing defining an annulus between the inner housing and the outer housing;

measuring data, via the casing collar locator and the gamma ray tool;

storing measured data, via an integrated memory system within the casing collar locator and the gamma ray tool;

directing fluid flow, via at least two ports disposed in the inner housing, out of the inner housing, into the annulus of the carrier sub, and toward an exit of the carrier sub; and isolating the sensor tool from fluid communication with the well by directing fluid flow via the at least two ports.

11. The method of claim 10, further comprising:

securing the sensor tool in place in the inner housing via a first threaded connection disposed at a first end of the sensor tool and a second threaded connection of the sensor tool disposed at a second end of the sensor tool; and removing the sensor tool from within the inner housing by unscrewing the first threaded connection or the second threaded connection, wherein inserting the sensor tool comprises screwing the first threaded connection or the second threaded connection.

12. The method of claim 11, wherein the first threaded connection is an inner threaded connection and the second threaded connection is an outer threaded connection.

13. The method of claim 11, wherein securing the sensor tool comprises sealing the first threaded connection and the second threaded connection using a seal.

14. The method of claim 10, wherein directing fluid flow comprises directing fluid flow via a flow nozzle.

15. The method of claim 10, further comprising:

coupling a first tool joint of the coiled tubing, via a third threaded connection, to a first end of the carrier sub.

16. The method of claim 15, further comprising:

coupling a second tool joint of the coiled tubing and securing the sensor tool, via a fourth threaded connection, to a second end of the carrier sub.

17. The method of claim 16, wherein the fourth threaded connection is slimmer than the third threaded connection.

18. The method of claim 10, wherein directing fluid flow comprises continuous fluid flow through the carrier sub.

* * * * *